US005509280A

United States Patent [19]

Schuler et al.

[11] Patent Number: 5,509,280

[45] Date of Patent: Apr. 23, 1996

[54] LATCH NEEDLE FOR TEXTILE MACHINES

[75] Inventors: Bernhard Schuler, Sonnenbühl; Siegfried Wissmann, Albstadt, both of Germany

[73] Assignee: Theodor Groz & Söhne & Ernst Beckert, Albstadt, Germany

[21] Appl. No.: 379,777

[22] Filed: Jan. 27, 1995

[30] Foreign Application Priority Data

Jan. 29, 1994 [DE] Germany ..... 44 02 706.0

[51] Int. Cl.[6] ..... D04B 35/04; D05B 85/14

[52] U.S. Cl. ..... 66/121; 66/122

[58] Field of Search ..... 66/121, 122; 163/3, 163/5; 403/288; 29/11

[56] References Cited

U.S. PATENT DOCUMENTS

| | | | |
|---|---|---|---|
| 1,433,123 | 10/1922 | Corey | 66/122 |
| 1,764,342 | 6/1930 | Parlini | 66/121 |
| 3,253,427 | 5/1966 | Pace et al. | 66/122 |
| 3,439,729 | 4/1969 | Beighton et al. | 66/122 |
| 3,677,035 | 7/1972 | Wiederhut et al. | 66/122 |
| 3,934,109 | 1/1976 | Shepard et al. | 219/121 L M |
| 3,998,259 | 12/1976 | Zoecher | 163/5 |
| 4,020,319 | 4/1977 | Shepard et al. | 66/122 X |
| 4,475,052 | 10/1984 | Okamoto et al. | 310/214 |
| 4,905,364 | 3/1990 | Berentzen | 29/413 |

FOREIGN PATENT DOCUMENTS

| | | | |
|---|---|---|---|
| 15064 | 10/1880 | Germany | 66/122 |
| 848342 | 9/1952 | Germany | 66/122 |
| 1097451 | 5/1986 | Japan | 66/122 |
| 44 | 1/1877 | United Kingdom | 66/122 |

*Primary Examiner*—John J. Calvert
*Attorney, Agent, or Firm*—Spencer & Frank

[57] ABSTRACT

A latch needle for textile machines has a needle shank having a longitudinal slot formed therein. The needle shank includes a needle hook located at one end of the needle shank, and two opposing shank cheeks each defining a lateral side of the longitudinal slot. A latch is pivotably disposed in the longitudinal slot. The latch has a bearing bore, and at least one annular ring projecting laterally outward from the latch and surrounding the bearing bore. A bearing device is attached to at least one of the shank cheeks and in communication with the bearing bore for pivotably seating the latch.

10 Claims, 3 Drawing Sheets

LATCH NEEDLE FOR TEXTILE MACHINES

CROSS-REFERENCE TO RELATED APPLICATIONS

This application claims the priority of application Ser. No. P 44 02 706.0, filed in Germany on Jan. 29, 1994, which is incorporated herein by reference.

BACKGROUND OF THE INVENTION

The present invention relates to a latch needle for textile machines, comprising: a needle shank having a longitudinal slot formed therein, the needle shank comprising a needle hook located at one end of the needle shank and two opposing shank cheeks each defining a lateral side of the longitudinal slot; a latch pivotably disposed in the longitudinal slot, the latch having a bearing bore; and bearing means attached to at least one of the shank cheeks and in communication with the bearing bore for pivotably seating the latch.

Conventionally used latch needles, such as disclosed in U.S. Pat. No. 3,934,109 and GB 836,297, typically comprise a needle shank, and a needle latch having a latch shank and a bearing bore. The needle latch is pivotably located in a longitudinal latch slot located within the needle shank, with the bearing bore being pivotably seated on two axle journals that have been pressed out of the needle shank cheeks. This form of seating is advantageous because the construction of the axle journals and the assembly of the needle shank onto the axle journals can be effected in one work cycle. Thus, the manufacture of such latch needles is very economical, and high output rates may be achieved.

Also known are latch needles having latch seatings which are significantly more precise and more wear-resistant than latch needles having pressed-out axle journals, such as disclosed in DE-AS 1 906 892 and DE 3 800 802. Use of this type of latch needle is increasing, particularly when a high-output needle is necessary, such as required for rapidly-running circular knitting machines. These latch needles have a needle shank seated on a throughgoing axial pin that has a smooth, cylindrical jacket surface. The axial pin, which can comprise two pin sections, is inserted into corresponding receiving bores in the shank cheeks. The axial pin is fixed inside the receiving bores by, for example, laser welding or stamp-molding so as to captively fix the pin against relative rotation.

It is also known from DE-AS 1 906 892 to connect the axial pin with the latch shank so as to fix these two parts against relative rotation, and to rotatably seat the ends of the axial pin within corresponding receiving bores in the shank cheeks. The axial pin includes an annular groove, and the latch shank has a corresponding annular ring located in a latch bearing bore for connecting the axial pin and the latch shank together.

For any latch needle, the needle latch must move easily in the longitudinal latch slot of the needle shank, i.e., the pivoting movement of the latch needle about the pressed axle journal or axial pin should generate as little friction as possible so that the movement is essentially unimpeded. To reduce the friction, a particular amount of lateral play is necessary between the adjacent shank cheeks and the base of the latch shank, which is positioned in the longitudinal slot and parallel to the shank cheeks. Thus, gaps are formed between the sides of the longitudinal slot and the adjacent shank cheeks.

During operation of the knitting machine, dust and fluff that detach from the processed yarn cannot be prevented from depositing on parts of the machines and the needles, and in particular, from entering the longitudinal slot. To prevent clogging of the longitudinal slot, the bottom of the slot, i.e., on the back of the needle shank, is typically provided with a through hole which allows the fluff to pass through. However, because the axle journals or axial pin lie exposed in the gap between the latch shank and shank cheeks, particularly finer impurities invariably deposit on these exposed portions. Thus, the impurities may mix with the lubricant provided for lubricating the latch bearing and may, over time, penetrate into the bearing bore of the latch shank. This results in an increased sluggishness and stiffness of the latch bearing, leading to corresponding heat build-up and increased wear, and ultimately to an undesired shortening of the service life of the latch needle. Further, as practical experience has shown, microfissures may also form over time in the region of the bearing bore, which may result in a premature breakage of the latch in the region of the latch bearing.

SUMMARY OF THE INVENTION

It is an object of the present invention to overcome the aforementioned disadvantages by creating a latch needle that has a low-wear latch seat and therefore a longer service life than conventional latch needles.

It is a further objective of the invention to provide a latch needle that can be economically mass produced and with consistent quality.

The above and other objects are accomplished according to the invention by the provision of a latch needle for textile machines, comprising: a needle shank having a longitudinal slot formed therein, the needle shank comprising a needle hook located at one end of the needle shank and two opposing shank cheeks each defining a lateral side of the longitudinal slot; a latch pivotably disposed in the longitudinal slot, the latch having a bearing bore, and at least one annular ring projecting laterally outward from the latch and surrounding the bearing bore; and bearing means attached to at least one of the shank cheeks and in communication with the bearing bore for pivotably seating the latch.

As used herein, "receiving bore" and "bearing bore" include all types of holes, regardless of whether they were produced in a boring or stamping process, by welding using a laser beam, drilling, or the like.

The annular ring essentially covers the bearing means, which may be either a pressed-in axle journal or an axial pin, in the respective exposed region to the side of the latch shank, so that, for example, fine dust or impurities from the processed yarn that enter the longitudinal slot cannot deposit on the axle journal or the axial pin.

The annular ring can be configured to rest against the front face of the associated inside surface of the shank cheek with little play by providing the annular ring with a planar surface that is processed in a suitable manner. Alternatively, an annular, groove-shaped recess can be provided in the shank cheek, so that the adjacent annular ring projects therein. Thus, the annular ring forms a labyrinth-type seal with the annular, groove-shaped recess, creating a particularly effective sealing condition. Advantageously, the axle journal or axial pin defines a radially inward side of the annular groove-shaped recess. However, it is also possible to arrange the annular groove-shaped recess and the annular ring at a slight radial distance from the circumferential surface of the axle journal or axial pin, so that a small, annular space is present between the recess and the bearing surface.

The profile of the recess can be selected to accomplish the stated objectives. Advantageously, the recess has an essentially partially circular cross-section, and the annular ring has an essentially partially circular, particularly semicircular, cross-section.

In addition, the latch can be treated in the region of the annular ring to be wear-resistant. For example, the region of the annular ring can include a protective coating, or alternatively, be hardened. Further, the annular ring to be finished, i.e., processed or machined.

Although a raised annular ring surrounding the bearing bore may be provided on both sides of the latch shank, it is also possible to provide the annular ring on only one side of the latch shank.

Because latch needles are items that are typically used in large quantities, it is important that the latch needles be produced economically and with consistent quality.

To manufacture the novel latch needle according to the invention, a needle shank is provided with a longitudinal slot, and a latch is provided with a bearing bore and at least one raised annular ring surrounding this bore. The longitudinal slot of the needle shank is laterally and elastically widened, and the latch is inserted into the longitudinal slot and correctly positioned. Next, the axle journal or axial pin, which projects into the bearing bore, is formed from or attached to the shank cheeks, which laterally define the longitudinal slot.

Preferably, the annular ring is formed onto the respective side of the latch shank by a pressing or embossing operation. However, the ring may also be formed, for example, using a cutting operation.

To prevent reducing the width of the bearing bore, the respective annular ring is preferably first formed on the latch before the latch and ring are provided with a hole. Afterwards, the latch may be provided with the bearing bore, which is effectively formed using, for example, a stamping process.

To economically provide an annular ring projecting into a corresponding, associated annular, groove-shaped recess, after inserting the latch into the longitudinal slot, the latch cheeks are forcibly pressed together and towards the latch. The respective raised, annular ring thus acts as a stamp die to form the annular, groove-shaped recess. When the shank cheeks are pressed together, the annular ring presses into the adjacent shank cheek, and creates the annular, groove-shaped recess precisely adapted to the shape of the annular ring. After completion of the pressing process, the shank cheeks elastically spring back to establish the lateral play necessary for the movability of the latch in the longitudinal slot. Thereafter, the axle journal or axial pin are formed or inserted.

The axle journals projecting out of the shank cheeks into the bearing bore of the latch are pressed out. Alternatively, instead of using axle journals, receiving bores may be provided in the shank cheeks, and an axial pin inserted into the bores, to be surrounded by the previously formed, annular, groove-shaped recess in the respective shank cheek.

When an axial pin is used, typically a latch needle is provided having shank cheeks. The shank cheeks are provided with receiving bores for the axial pin, and have a diameter larger than a diameter of the raised annular ring. Thus, after the latch is inserted into the longitudinal slot, the raised annular ring is received within the receiving bore. The pin is inserted into the receiving bore of the shank cheeks and the bearing bore of the latch shank, and is subsequently fixed at its end to the associated shank cheeks using, for example, a pressing process or laser welding operation. Therefore, when the axial pin is fixed, the annular, groove-shaped recess comprises an inner-lying annular gap that is open towards the longitudinal slot.

Preferably, prior to insertion into the longitudinal slot, the latch can be treated to be hardened or coated in the region of the annular ring, so as to increase the wear-resistance of the latch. The annular ring can be manufactured directly on the latch, which comprises needle-grade steel, by press-molding, pressing or general plastic deformation of the latch shank. Alternatively, the annular ring can be produced by metal-cutting deformation or by a finishing operation.

The concept of the invention is not limited to latch needles for knitting machines. It applies to all knitting tools that have a shank having at least one longitudinal latch slot in which a latch or comparable element is seated to pivot to a limited extent around an axle journal or axial pin.

The invention will be described below in greater detail in connection with embodiments thereof that are illustrated in the drawing figures.

BRIEF DESCRIPTION OF THE DRAWINGS

FIGS. 5 and 6 are sectional views of a partially manufactured latch shank, in a section corresponding to a completed latch shank taken along line V—V of FIG. 2, and FIGS. 7–9 are sectional views of a partially manufactured and completed latch needle, respectively, in a section corresponding to a completed latch needle taken along line VII—VII of FIG. 1.

DETAILED DESCRIPTION OF THE INVENTION

Figure 1:
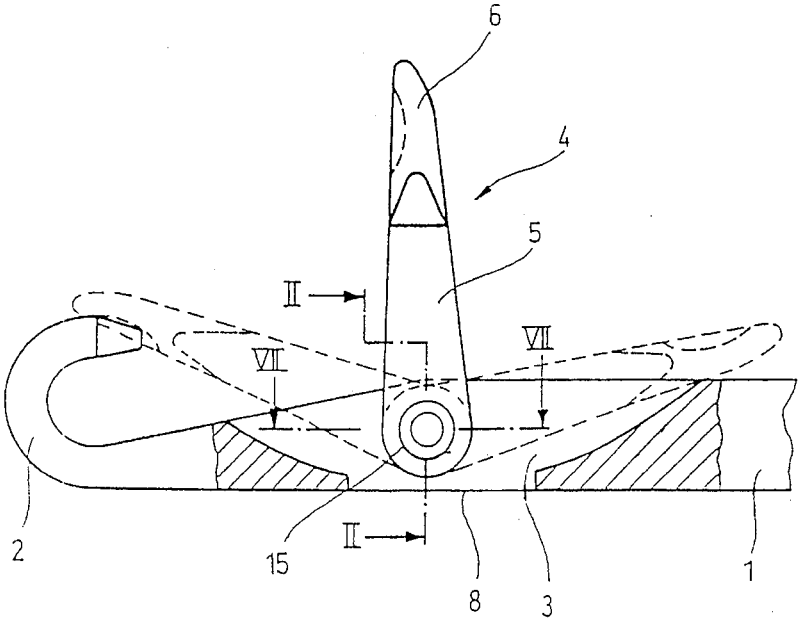
FIG. 1 illustrates a side, partial and enlarged view of a latch needle according to the invention having the longitudinal slot shown in section.
Figure 2:
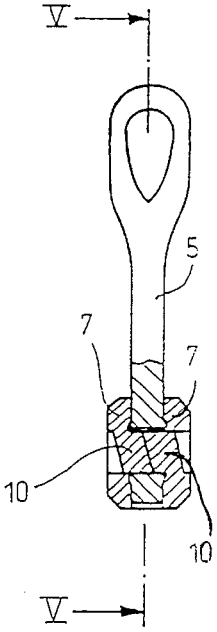
FIG. 2 shows a sectional view of the latch needle according to FIG. 1 along section line II—II.

Referring to FIGS. 1 and 2, a latch needle used in textile machines, and particularly in knitting machines is illustrated. The latch needle includes a needle shank 1, which has a formed-on needle hook 2 at one end. Needle shank 1 is provided with a longitudinal latch slot 3, in which a pivotal needle latch 4 (hereinafter referred to as "latch") is seated.

Latch 4 is pivotal between the limit positions indicated in dashed lines in FIG. 1, and includes a latch shank 5 parallelably flanked on its lateral sides between the limit positions. Latch 4 further includes a noucat 6 adjoining latch shank 5. Noucat 6 cooperates in the one (left) limit position with the point of needle hook 2, and lies with its back on the top side of needle shank 1 in the other (right) limit position.

Longitudinal slot 3 is defined on both sides by two shank cheeks 7. Shank cheeks 7 extend outwardly towards the associated, parallel side surfaces of latch shank 5 to define a space therebetween for lateral play. The base of longitudinal slot 3 is provided with a hole 8 extending through to the back of the needle. Hole 8 allows fluff to pass through the longitudinal slot.

Figure 3:
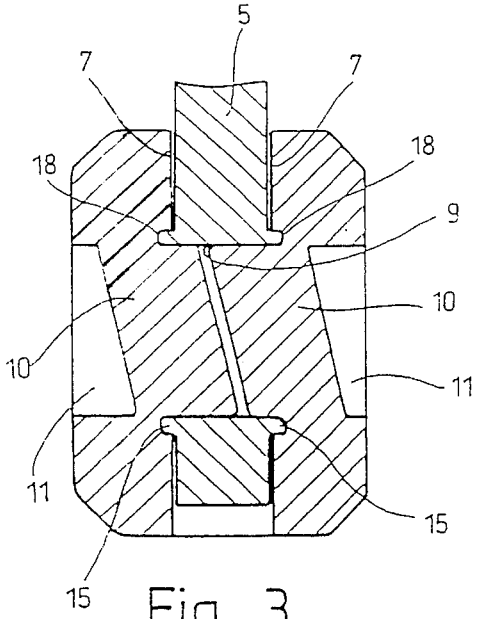
FIG. 3 is an enlarged sectional representation of the latch needle of FIG. 1 and corresponding to FIG. 2.

Referring also to FIG. 3, latch shank 5 has a rounded end positioned in longitudinal slot 3. The rounded end of latch shank 5 includes a throughgoing, cylindrical bearing bore 9 for pivotably seating latch 4 on a corresponding cylindrical bearing formed on shank cheeks 7.

In the embodiment according to FIGS. 1 through 3, the bearing is formed by two axle journals 10, which are pressed out of shank cheeks 7 in a manner known per se so that they project into bearing bore 9 of latch shank 5. The pressing marks 11 resulting in shank cheeks 7 are best illustrated in FIG. 3.

Referring briefly to FIGS. 10 through 14, a second embodiment of the invention is illustrated. In this embodiment, the bearing comprises a cylindrical axial pin 12 having a chamfered end (FIG. 14) that is inserted into corresponding, aligned receiving bores 13 in shank cheeks 7. Axial pin 12 is fixed in receiving bores 13 at the outside 14 of shank cheeks 7, for example by laser welding.

Figure 4:
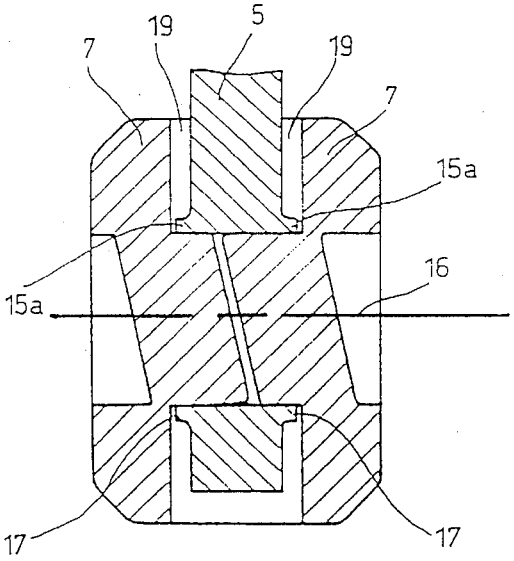
FIG. 4 is a sectional representation similar to FIG. 3, but showing a modified embodiment of the latch seating.

Referring back to FIGS. 1 through 3 and to FIG. 4, latch shank 5 is provided on both sides with a formed-on annular ring 15, which is coaxial with and directly surrounds bearing bore 9. In the embodiment according to FIGS. 1 through 3, the cross-section of each annular ring 15 is essentially semicircular in profile. In the embodiment according to FIG. 4, each annular ring **15*a* has an approximately rectangular cross-section with a planar end surface 17 extending at a right angle to the bearing bore axis 16**.

In the embodiment according to FIGS. 1 through 3, an annular, groove-shaped recess 18 is provided in shank cheeks 7, opposite the two annular rings 15. The profile of recess 18 essentially corresponds to the respective annular ring 15, which is received in recess 18 with a slight lateral play. Thus, each annular ring 15 forms a labyrinth seal with the associated, annular, groove-shaped recess 18. This seal seals the circumferential surface of axle journals 10 (which form the bearing surface) on both sides of latch shank 5, so that fine impurities from the processed yarn, etc. are prevented from penetrating into the bearing gap.

As FIG. 4 shows, annular, groove-shaped recesses 18 can be omitted, for example when fewer impurities in the operating atmosphere are expected. In this embodiment, the two annular rings **15*a* project directly up to the inside surfaces of the two shank cheeks 7. Thus, the gap 19, located on both sides of latch shank 5 and necessary for the lateral movability of latch 4, can be selected to be relatively large. The circumferential surface of axle journals 10 and thus their bearing surface are still extensively covered in the region of the two gaps 19 by the two annular rings 15*a*. Planar surfaces 17 of annular rings 15*a* can be machined or processed to form defined, annular, lateral bearing surfaces that provide precise lateral guidance of latch shank 5 directly to shank cheeks 7**.

In all situations, the cylindrical bearing surface of bearing bore 9 is axially elongated by annular rings 15, **15*a*, so that the latch seating is improved and an additional lateral latch guidance is provided. As mentioned, the lateral latch guidance is accomplished using planar surfaces 17 that provide precise lateral guidance of latch shank 5 directly to shank cheeks 7. However, the lateral latch guidance is also accomplished in the embodiment according to FIGS. 1 through 3 by the walls of annular, groove-shaped recesses 18 and annular rings 15**.

Of course, the profile of annular rings 15 can be selected to be adapted to the respective requirements necessary to accomplish the objective. The embodiment according to FIG. 4, with the rectangular cross-section, is only one possibility; another possibility would be, for example, to form the annular rings with a cupped, gripping point, or with small, annular recesses.

Referring to FIGS. 5 through 9, various manufacturing stages of the latch needle shown in FIGS. 1 through 3, and in particular the latch seating, are illustrated.

Figure 5:
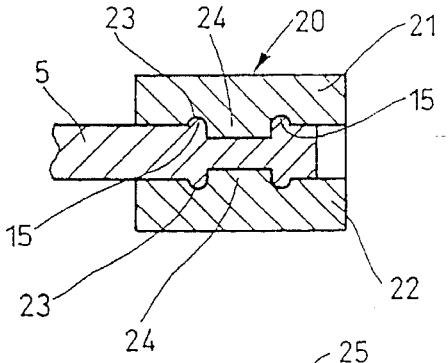
FIGS. 5 through 9 illustrate the various stages in the manufacture of the latch and the latch seating of the latch needle according to FIG. 1.

Referring to FIG. 5, latch 4, which is preformed with noucat 6 and latch shank 5 but without bearing bore 9, is inserted into a press-mold die comprising an upper die part 21 and lower die part 22. The press-mold die includes an annular, groove-shaped recess 23 that corresponds to annular ring 15. Recess 23 encompasses a circular, central region 24 which projects outwardly relative to the surrounding die surface.

Annular ring 15 is formed on both sides of latch shank 5 by pressing together upper die part 21 and lower die part 22. Alternatively, the two annular rings 15 could be pressed onto a latch shank 5 already provided with a hole.

Figure 6:
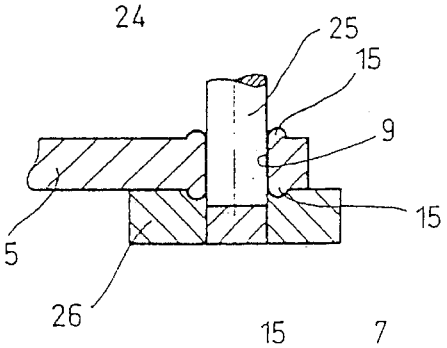

As shown in FIG. 6, in the next step latch shank 5 is provided with the cylindrical bearing bore 9 concentric to the two annular rings 15 by using a punching die 25 and an associated female mold 26.

If desired, the latch shank can subsequently be hardened, at least in the region of annular rings 15.

Figure 7:
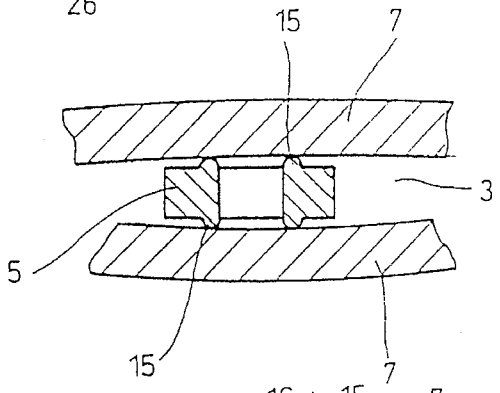

Next, latch shank 5 of the completed latch 4 is inserted into longitudinal slot 3 of needle shank 1, as shown in FIG. 7, after longitudinal slot 3 has been laterally widened to the necessary degree by elastically deforming shank cheeks 7 with a suitable tool. At this stage, shank cheeks 7 are defined on both sides of longitudinal slot 3 by smooth side walls, i.e., axle journals 10 are not formed yet.

After latch shank 5 has been correctly positioned in longitudinal slot 3, the two shank cheeks 7 are pressed toward one another and toward latch shank 5 using a suitable pressing tool. In the process, shank cheeks 7 are pressed flat, while simultaneously, the annular rings penetrate into the respectively adjacent side walls of shank cheeks 7, creating by plastic material deformation the permanent, annular, groove-shaped recess 18. The profile of recess 18 corresponds exactly to the profile of the respective annular ring 15.

Figure 8:
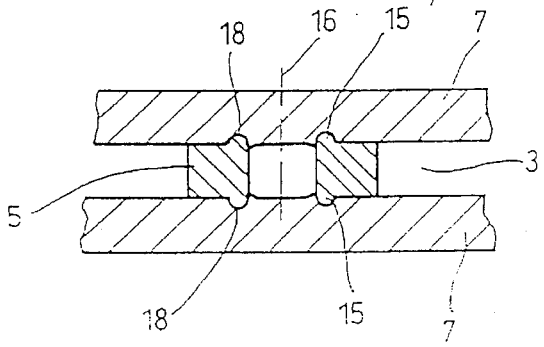
Figure 9:
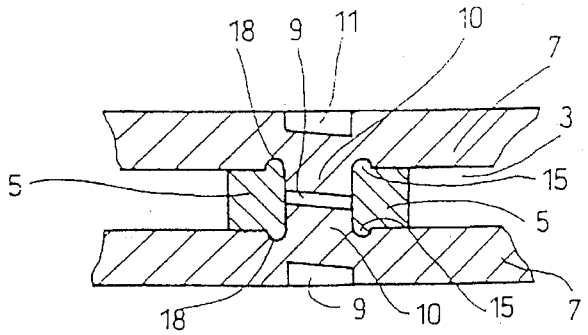

The end result of this method is illustrated in FIG. 8. After being pressed together, shank cheeks 7 spring slightly back due to their own elasticity. Thus, the lateral play necessary for free movement of latch 4 in longitudinal slot 3, between latch shank 5 and longitudinal slot 3, and between the two annular rings 15 and the respective annular, groove-shaped recesses 18 is obtained.

Axle journals 10 are subsequently pressed out of shank cheeks 7 using suitable pressing tools. The axle journals are pressed into bearing bore 9 of latch shank 4, typically from both sides, thus concluding the manufacturing process of the latch seating. Only conventional, known finishing work remains.

The manufacture of the modified embodiment of the latch seating is effected in a basically similar manner, as shown in FIGS. 10 through 14. In this modified embodiment, the bearing comprises axial pin 12, which is inserted into receiving bores 13 and fixed in shank cheeks 7 so as to be coaxial with the bores 13.

Figure 10:
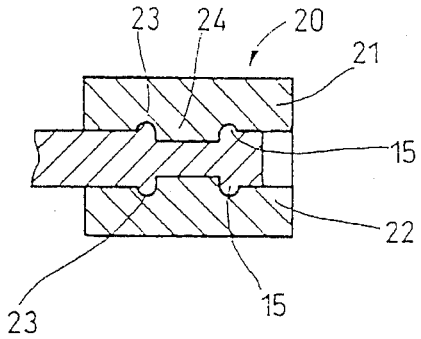
FIGS. 10 through 14 illustrate the various stages in the manufacture of a modified latch, corresponding to those shown in FIGS. 5 through 9, but in which a cylindrical axial pin is inserted into the shank cheeks.
Figure 11:
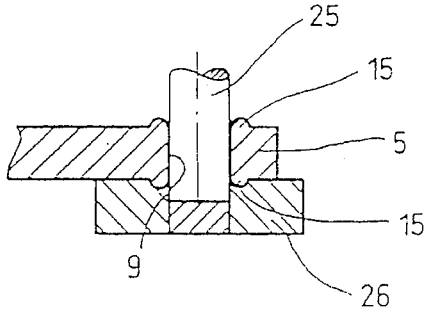
Figure 12:
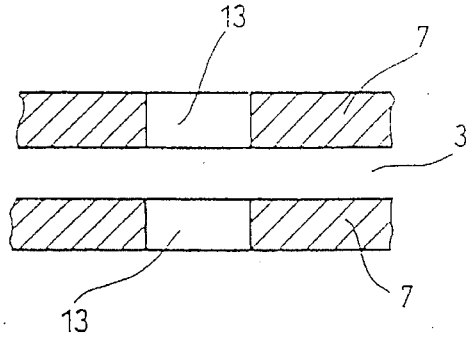

In this manufacturing process, shank 5 is first provided with pressed-on, coaxial annular rings 15 and bearing bore 9 in accordance with the various manufacturing stages illustrated in FIGS. 10 and 11, and in a manner similar to that already explained in conjunction with FIGS. 5 and 6.

The two coaxial receiving bores 13 are next punched into shank cheeks 7. The bore diameter of the respective receiving bores corresponds essentially to the outside diameter of the two annular rings 15, taking into consideration the necessary bearing play.

Next, needle shank cheeks 7 are elastically, lateral widened, and latch shank 5 is inserted into longitudinal slot 3 of needle shank 1. Latch shank 5 is positioned so that the annular rings lie coaxially with axis 16 of receiving bores 13.

Figure 13:
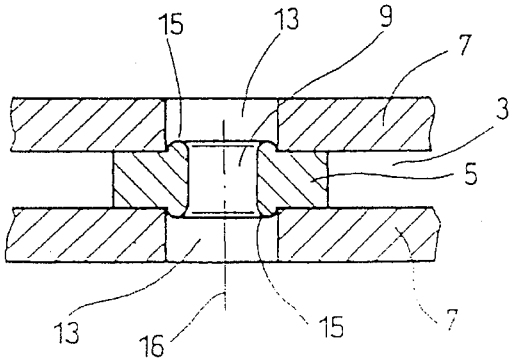

As shown in FIG. 13, once shank cheeks 7 are returned to their relaxed initial position as previously described, annular rings 15 will cause needle shank 5 to be seated in receiving bores 13.

Axial pin 12 is subsequently inserted into bearing bore 9 of latch shank 5. Axial pin 12 has a length dimensioned so that the end of the pin is approximately flush with the outside of shank cheek 7, once the pin is fully inserted.

In the next step, axial pin 12 is fixed in shank cheeks 7. To accomplish the fixing, two coaxial, annular, groove-shaped recesses 28 that coaxially surround receiving bores 13 with radial spacing are pressed into shank cheeks 7 from the outside (i.e., from a side opposite the lateral slot). The pressing of recesses 28 causes the material forming shank cheeks 7 to be displaced radially inward in an annular, ring fashion and into the outer-lying end regions 29 of receiving bores 13, to seal receiving bores 13 at the outside and, simultaneously captively fixing axial pin 12.

Figure 14:
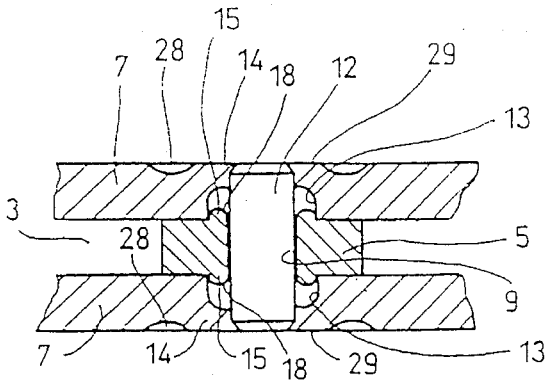

Receiving bores 13 are not filled over their entire length with the material that fixes axial pin 12 at the outer-lying end regions 29, as shown in FIG. 14. Thus, annular, groove-shaped recess 18 comprises an annular gap formed by the displacement of the material. Further, the inside wall of the respective receiving bore 13 on each side of latch shank 5 securely receives the respectively associated annular ring 15.

Alternatively, the axial pin 12 can be fixed in the shank cheeks using a laser welding operation, or other suitable means.

The completed latch needle may now be subjected to any remaining manufacturing process steps. These production steps are known for latch needles, and need not be described in detail.

The axial height of annular ring 15, 15*a* depends on the dimensions of latch 4 and the shank dimensions. Typically, the height is in a range of a few 1/100 mm. In finer latches, the height may be approximately 1/100 to 2/100 mm, and in coarser, heavier latches, the height may be up to 5/100 mm or more.

The invention now being fully described, it will be apparent to one of ordinary skill in the art that any changes and modifications can be made thereto without departing from the spirit or scope of the invention as set forth herein.

What is claimed is:

1. A latch needle for textile machines, comprising:

a needle shank having a longitudinal slot formed therein, said needle shank comprising:

a needle hook located at one end of said needle shank; and two opposing shank cheeks each defining a lateral side of the longitudinal slot;

a latch pivotably disposed in the longitudinal slot, said latch having a bearing bore, and at least one annular ring projecting laterally outward from said latch and surrounding the bearing bore; and bearing means attached to at least one of said shank cheeks and in communication with said bearing bore for pivotably seating said latch.

2. The latch needle as defined in claim 1, wherein said annular ring has an essentially semicircular cross-section.

3. The latch needle as defined in claim 1, wherein said annular ring has an essentially rectangular cross-section.

4. The latch needle as defined in claim 1, wherein at least one of said shank cheeks includes an annular groove-shaped recess having said annular ring projecting therein.

5. The latch needle as defined claim 4, wherein said bearing means defines a radially inward side of said annular groove-shaped recess.

6. The latch needle as defined in claim 1, wherein said bearing means comprise an axle journal formed from said at least one shank cheek to project into the bearing bore of said latch.

7. The latch needle as defined in claim 1, wherein said bearing means comprise at least one axial pin having an end fixed to said at least one shank cheek.

8. The latch needle as defined claim 1, wherein said latch is hardened in a region of said annular ring to be wear-resistant.

9. The latch needle as defined claim 1, wherein said latch includes a protective coating in a region of said annular ring to be wear-resistant.

10. The latch needle as defined in claim 1, wherein a surface of said annular ring is finished.

* * * * *